US009437410B2

(12) United States Patent
Thomson et al.

(10) Patent No.: US 9,437,410 B2
(45) Date of Patent: Sep. 6, 2016

(54) SYSTEM AND METHOD FOR APPLYING CURTAIN GAS FLOW IN A MASS SPECTROMETER

(71) Applicant: DH Technologies Development Pte. Ltd., Singapore (SG)

(72) Inventors: Bruce A. Thomson, Toronto (CA); Mircea Guna, North York (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 14/359,853

(22) PCT Filed: Nov. 21, 2012

(86) PCT No.: PCT/IB2012/002436

§ 371 (c)(1),
(2) Date: May 21, 2014

(87) PCT Pub. No.: WO2013/076560

PCT Pub. Date: May 30, 2013

(65) Prior Publication Data

US 2014/0319338 A1 Oct. 30, 2014

Related U.S. Application Data

(60) Provisional application No. 61/561,977, filed on Nov. 21, 2011.

(51) Int. Cl.
*H01J 49/26* (2006.01)
*H01J 49/04* (2006.01)

(52) U.S. Cl.
CPC ..... *H01J 49/0422* (2013.01); *H01J 49/044* (2013.01); *H01J 49/26* (2013.01)

(58) Field of Classification Search
USPC ..... 250/281, 282, 283, 288
See application file for complete search history.

(56) References Cited

U.S. PATENT DOCUMENTS

| | | | | |
|---|---|---|---|---|
| 2004/0094706 | A1 | 5/2004 | Covey et al. | |
| 2004/0217280 | A1 | 11/2004 | Schneider et al. | |
| 2005/0269506 | A1 | 12/2005 | Kalinitchenko | |
| 2007/0181800 | A1 * | 8/2007 | Jolliffe ..... | G01N 30/7233 250/288 |

OTHER PUBLICATIONS

Written Opinion of the International Searching Authority for PCT/IB2012/002436, mailed Mar. 28, 2013.
International Search Report for PCT/IB2012/002436, mailed Mar. 28, 2013.
International Preliminary Report on Patentability for PCT/IB2012/002436, mailed May 27, 2014.

* cited by examiner

*Primary Examiner* — Nicole Ippolito

(57) ABSTRACT

A system of mass spectrometry is disclosed having an ion source for generating ions at substantially atmospheric pressure. The system has a sampling member with an orifice disposed therein. The sampling member forms a vacuum chamber with a mass spectrometer. The system also has a curtain plate between the ion source and the sampling member. The curtain plate has an aperture therein, having a cross-section and being spaced from the sampling member to define a flow passage between the curtain plate and the sampling member, and to define an annular gap between the orifice and the aperture. The area of the annular gap is less than the cross-sectional area of the aperture. The system also has a power supply for applying a voltage to the curtain plate, and a curtain gas flow mechanism for directing a curtain gas into the flow passage and the annular gap.

7 Claims, 10 Drawing Sheets

SYSTEM AND METHOD FOR APPLYING CURTAIN GAS FLOW IN A MASS SPECTROMETER

RELATED APPLICATION

This application claims priority to U.S. provisional application no. 61/561,977 filed Nov. 21, 2011, which is incorporated herein by reference in its entirety.

FIELD

The applicants' teachings relate to a system and method of mass spectrometry. More specifically, the applicants' teachings relate to curtain gas flow in a mass spectrometer.

INTRODUCTION

The most common solvents used in liquid chromatography (LC) are methanol, acetonitrile, and water. The same solvents are used with Liquid Chromatography/Mass Spectrometry (LC/MS). In typical electrospray ion sources, the solvent is a sprayed or nebulized in the form of small highly charged droplets. These droplets must be evaporated to release the analyte ions in the droplets into the gas phase. Typically, some fraction of the droplets is not evaporated, or some of the droplets are only partially evaporated, leaving a mixture of ions, droplets, and clusters in the ion source. Clusters are essentially microscopic droplets.

Water is particularly difficult to evaporate since it is less volatile than methanol or acetonitrile. Thus, if the LC solvent contains a mixture of water and methanol or acetonitrile, any remaining droplets and clusters will largely consist of water.

As it is known in the art, a gas curtain consists of a flowing curtain of gas, typically nitrogen, that covers the orifice separating the ion source from the first vacuum chamber of the mass spectrometer. The curtain gas flow direction is generally away from the orifice into the ion source, with some of the gas flow being drawn into the vacuum chamber. The counterflow of the gas acts as a curtain or membrane to exclude gases and contaminants as well as particles, droplets, and clusters from entering the vacuum chamber while allowing higher mobility ions to be focused and transmitted into the vacuum system. However, at high liquid flow rates, the gas curtain can be less efficient in excluding the droplets. Turbulent gas flow in the ion source region can cause droplets to penetrate through the curtain gas and be carried by suction into the vacuum chamber. Therefore, a need exists to provide a system and apparatus for applying a curtain gas that is more efficient in excluding particles, droplets, and clusters, while allowing more of the ions to be transmitted into the vacuum chamber.

SUMMARY

In accordance with an aspect of the applicants' teachings, there is provided a mass spectrometer system comprising an ion source for generating ions at substantially atmospheric pressure, a sampling member having an orifice therein, the sampling member forming a vacuum chamber with a mass spectrometer, a curtain plate between the ion source and the sampling member, the curtain plate having an aperture therein, the aperture having a cross-section and being spaced from the sampling member to define a flow passage between the curtain plate and the sampling member, and to define an annular gap between the orifice and the aperture, the area of the annular gap being less than the cross-sectional area of the aperture, a power supply for applying a voltage to the curtain plate to direct ions from the ion source to the aperture in the curtain plate, and a curtain gas flow mechanism for directing a curtain gas into the flow passage and the annular gap.

In accordance with another aspect of the applicant's teachings there is provided a mass spectrometer system comprising an ion source for generating ions at substantially atmospheric pressure, at least two curtain plates, each curtain plate of the at least two curtain plates having an aperture, each curtain plate spaced to form a plurality of flow passages therebetween, a sampling member having an orifice therein, the sampling member forming a vacuum chamber with a mass spectrometer, the sampling member being spaced away from the at least two curtain plates forming a flow passage therebetween, a power supply voltage for applying independent voltages to each curtain plate to direct ions through each of the apertures of each curtain plate, and at least one gas flow mechanism for directing curtain gases into each of the plurality of flow passages. In various embodiments, the curtain gases have different composition.

In accordance with another aspect of the applicant's invention there is provided a mass spectrometer system comprising an ion source for generating ions at substantially atmospheric pressure, a first curtain plate having a first aperture, a second curtain plate having a second aperture being spaced away from the first curtain plate defining a first curtain chamber therebetween, a sampling member having an orifice therein, the sampling member forming a vacuum chamber with a mass spectrometer, the sampling member being spaced away from the second curtain plate defining a second curtain chamber therebetween, a first curtain gas flow mechanism for directing a first curtain gas into the first curtain chamber, a power supply for applying a first voltage to the first curtain plate to direct ions from the ion source to the first aperture and for applying a second voltage to the second curtain plate to direct ions from the first aperture to the second aperture, and a second curtain gas flow for directing a second curtain gas into the second curtain chamber. In various embodiments, the first and second curtain gases have different composition.

In accordance with a further aspect of the applicant's invention there is provided an ion sampling interface for receiving ions from an ion source, the ion sampling interface comprising a first curtain plate having a first aperture therein for receiving the ions from the ion source, a second curtain plate having a second aperture therein, the second curtain plate spaced from the first curtain plate to form a curtain chamber therebetween, a sampling member having an orifice therein, the sampling member forming a vacuum chamber with a mass spectrometer; the sampling member, spaced from the second curtain plate to form a curtain flow channel therebetween, the sampling member defining an annular gap between the orifice and the second aperture, the area of the annular gap being less than the cross-sectional area of the aperture, a first power supply for applying a voltage to the curtain plate to direct ions from the ion source to the first aperture in the first curtain plate, a second power supply for applying a voltage to the second curtain plate to direct ions to the orifice, and a curtain gas flow mechanism for directing a curtain gas into the flow passage and the annular gap, the curtain gas generating a high velocity jet of gas across the orifice as the curtain gas flow passes through the annular gap.

These and other features of the applicants' teachings are set forth herein.

BRIEF DESCRIPTION OF THE DRAWINGS

The skilled person in the art will understand that the drawings, described below, are for illustration purposes only. The drawings are not intended to limit the scope of the applicants' teachings in anyway.

In the drawings, like reference numerals indicate like parts.

DESCRIPTION OF VARIOUS EMBODIMENTS

Figure 1:
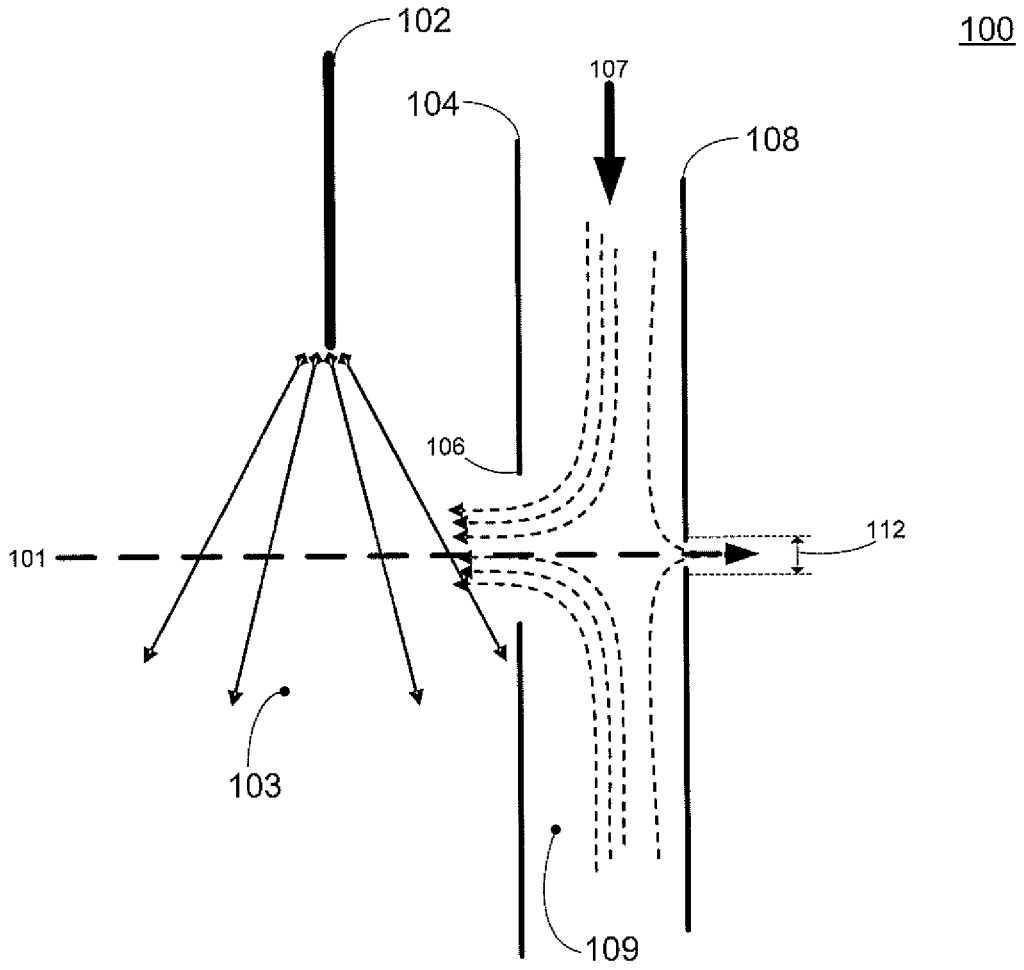
Figure 1 (Prior Art)
FIG. 1 is a schematic illustration of a prior art ion sampling interface for a mass spectrometer having a gas curtain.

Reference is first made to FIG. 1 which schematically illustrates a typical ion sampling interface configuration as is known in the art, and is generally referred by the numeral 100. Ion source 102 generates ions 103 at substantially atmospheric pressure. The types of ion sources 102 that can be utilized can be but are not limited to atmospheric pressure ion sources such as electrospray, nanoelectrospray, heated nebulizer, atmospheric pressure chemical ionization (APCI), photospray, or gaseous phase ion sources such as chemical ionization.

Ions 103 are sent in the direction 101 towards a mass spectrometer sample inlet structure which includes a curtain plate aperture 106 located in a curtain plate 104. These ions are drawn through the aperture 106 through a curtain flow gas 107 towards an orifice 112 located in sampling member 108 which leads into the vacuum stage of the mass spectrometer (not shown). As is known in the art, sampling member 108 can be but is not limited to a plate or an intake tube. The curtain plate 104 and the sampling member 108 are spaced to form a curtain chamber 109 through which the curtain gas 107 is discharged. The curtain chamber 109 is typically at a pressure of close to or slightly greater than atmospheric pressure so that at least some of the flowing curtain gas 107 flows outward into the ion source, while some of the flowing curtain gas 107 flows into the vacuum chamber. In this example, both the aperture 106 and the orifice 112 are aligned along a common axis 101 so that both the aperture 106 and the orifice 112 are "coaxially aligned" as the term is used herein.

Typical voltages applied by a power source (not shown) to the curtain plate 104, and the sampling plate 108 are 1000V and 100V, respectively. These voltages ensure the positive ions are directed from the ion source 102 to the sampling plate aperture 108 whereupon the atmosphere gas flow carries them into the low pressure region of the first stage of a mass spectrometer. For negative ion detection the polarity of these typical voltages are −1000V and −100V, respectively. The spacing between the curtain plate aperture 106 and the sampling plate orifice 112 is selected to be sufficiently small that ions can be efficiently focused through the space toward the sampling plate with minimal losses. However, the spacing is also selected to be sufficiently large that droplets and clusters are either excluded from the space, so that they do not reach the sampling orifice, or else they have sufficient residence time in the curtain gas region to become completely or nearly completely evaporated. Since these two design considerations are contradictory, a compromise is sought.

Existing prior art curtain gas configurations may have spacings that are small enough for sufficient ion focusing and therefore high sensitivity. However, this allows some droplets to penetrate and reach the sampling orifice and be carried into the vacuum chamber. For example, when the solvent flow from the LC is high, for example 0.5 mL/min or larger, and contains high concentrations of water, for example greater than 50%, then the desolvation may be insufficient, and droplets from ion source 102 can be sampled into the mass spectrometer. Therefore, contaminating particles can enter the mass spectrometer, decreasing stability, ruggedness and ease of use.

Figure 2:
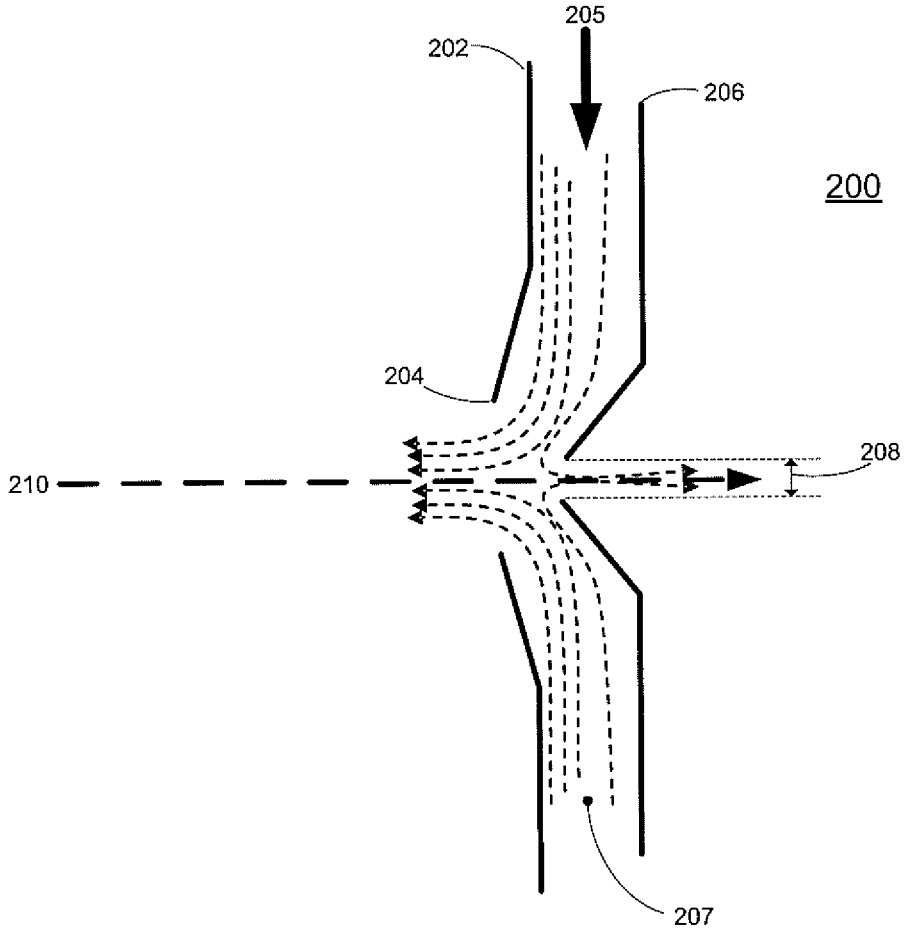
Figure 2 (Prior Art)
FIG. 2 is a schematic illustration of a prior art alternate configuration of an ion sampling interface for a mass spectrometer having a gas curtain.

FIG. 2 shows a prior art alternate geometry 200 of the sampling interface shown in FIG. 1. In this configuration, the curtain aperture 204 conically protrudes from the curtain plate 202. The sample orifice 208 similarly conically protrudes from the sampling member 206. As in FIG. 1, the aperture 204 and the orifice 208 are coaxially aligned along the axis 210. Curtain plate 202 and sample member 206 are spaced to form a curtain chamber 207 through which the curtain flow gas 205 is discharged.

In various embodiments, there can be provided a mass spectrometer system comprising an ion source for generating ions at substantially atmospheric pressure. In various aspects, a sampling member can be provided having an orifice therein, the sampling member forming a vacuum chamber with a mass spectrometer. In various aspects, a curtain plate can be provided between the ion source and the sampling member, the curtain plate having an aperture therein, the aperture having a cross-section and being spaced from the sampling member to define a flow passage between the curtain plate and the sampling member, and to define an annular gap between the orifice and the aperture. In various embodiments, the area of the annular gap can be less than the cross-sectional area of the aperture, a power supply for applying a voltage to the curtain plate to direct ions from the ion source to the aperture in the curtain plate, and a curtain gas flow mechanism can be provided for directing a curtain gas into the flow passage and the annular gap.

In various embodiments, the area of the annular gap can be less than 50% of the area of the aperture. In various aspects, the annular gap can be less than 0.5 mm. In various aspects, the annular gap can be less than 0.3 mm. In various aspects, the curtain gas can form a high velocity jet in front of the orifice.

In various embodiments, there can be provided a mass spectrometer system comprising an ion source for generating ions at substantially atmospheric pressure. In various aspects, at least two curtain plates can be provided, each curtain plate of the at least two curtain plates can have an aperture. In various aspects, each curtain plate can be spaced to form a plurality of flow passages therebetween. In various embodiments, a sampling member can be provided. In various aspects, the sampling member can have an orifice therein. In various aspects, the sampling member can form a vacuum chamber with a mass spectrometer. In various aspects, the sampling member can be spaced away from the at least two curtain plates forming a flow passage therebetween. In various embodiments, a power supply voltage can be provided for applying independent voltages to each curtain plate to direct ions through each of the apertures of each curtain plate. In various aspects, at least one gas flow mechanism can be provided for directing curtain gases into each of the plurality of flow passages. In various embodiments, the curtain gases have different composition.

In various embodiments, there can be provided a mass spectrometer system comprising an ion source for generating ions at substantially atmospheric pressure. In various aspects, a first curtain plate can be provided having a first aperture. In various embodiments, a second curtain plate can be provided having a second aperture being spaced away from the first curtain plate defining a first curtain chamber therebetween. In various aspects, a sampling member can be provided having an orifice therein. In various embodiments, the sampling member can form a vacuum chamber with a mass spectrometer.

In various aspects, the sampling member can be spaced away from the second curtain plate defining a second curtain chamber therebetween. In various embodiments, a first curtain gas flow mechanism can be provided for directing a first curtain gas into the first curtain chamber. In various aspects, a power supply can be provided for applying a first voltage to the first curtain plate to direct ions from the ion source to the first aperture and for applying a second voltage to the second curtain plate to direct ions from the first aperture to the second aperture. In various embodiments, a second curtain gas flow can be provided for directing a second curtain gas into the second curtain chamber. In various embodiments, the first and second curtain gases have different composition.

In various embodiments, there can be provided an ion sampling interface for receiving ions from an ion source. In various aspects, the ion sampling interface can comprise a first curtain plate having a first aperture therein for receiving the ions from the ion source. In various aspects, a second curtain plate can be provided having a second aperture therein. In various embodiments, the second curtain plate can be spaced from the first curtain plate to form a curtain chamber therebetween. In various embodiments, a sampling member can have an orifice therein. In various aspects, the sampling member can form a vacuum chamber with a mass spectrometer. In various aspects, the sampling member can be spaced from the second curtain plate to form a curtain flow channel therebetween. In various embodiments, the sampling member can define an annular gap between the orifice and the second aperture. In various aspects, the area of the annular gap can be less than the cross-sectional area of the aperture. In various embodiments, a first power supply can be provided for applying a voltage to the curtain plate to direct ions from the ion source to the first aperture in the first curtain plate. In various aspects, a second power supply can be provided for applying a voltage to the second curtain plate to direct ions to the orifice. In various aspects, a curtain gas flow mechanism can be provided for directing a curtain gas into the flow passage and the annular gap. In various aspects, the curtain gas can generate a high velocity jet of gas across the orifice as the curtain gas flow passes through the annular gap.

Figure 3:
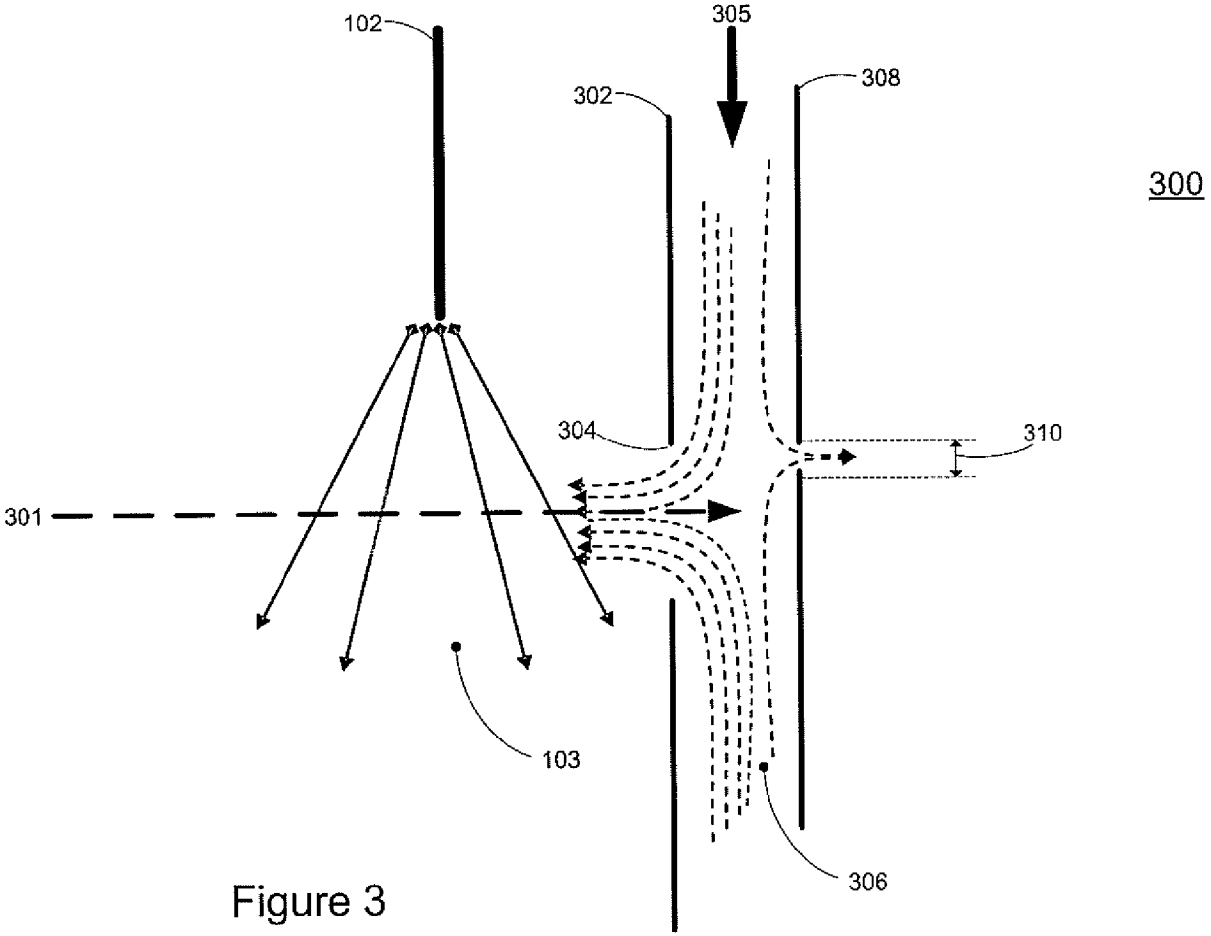
FIG. 3 schematically illustrates an exemplary modified ion sampling interface configuration in accordance with the applicants' teachings.

FIG. 3 illustrates an example of a modified sampling interface indicated by the numeral 300. Ion source 102 generates ions 103 at substantially atmospheric pressure. Ions 103 are sent in the direction 101 to an aperture 304 in a curtain plate 302. These ions are drawn through the aperture 304 into a curtain flow chamber 306 formed between the curtain plate 302 and a sampling member 308. The curtain chamber 306 is typically at a pressure of close to or slightly greater than atmospheric pressure, so that at least some of the flowing curtain gas flows outward into the ion source, while some of the flowing curtain gas flows into the vacuum chamber. Ions 103 move through a curtain flow gas 305 in the curtain chamber 306 towards an orifice 310 located in sampling member 308 which leads into the vacuum stage of the mass spectrometer (not shown). The curtain plate 302 and the sampling member 308 are spaced to form a curtain flow chamber 306 through which the curtain flow gas 305 is discharged. In this example, the center of the orifice 310 is not aligned with the center of the aperture 304. In the example of FIG. 3, the orifice 310 is shifted higher on an orthogonal axis in relation to the aperture 304. Gas flow from the ion source 102 carries the heavier droplets and clusters down away from the orifice 310, whereas the lighter ions will turn and flow into the orifice 310.

Figure 4C:
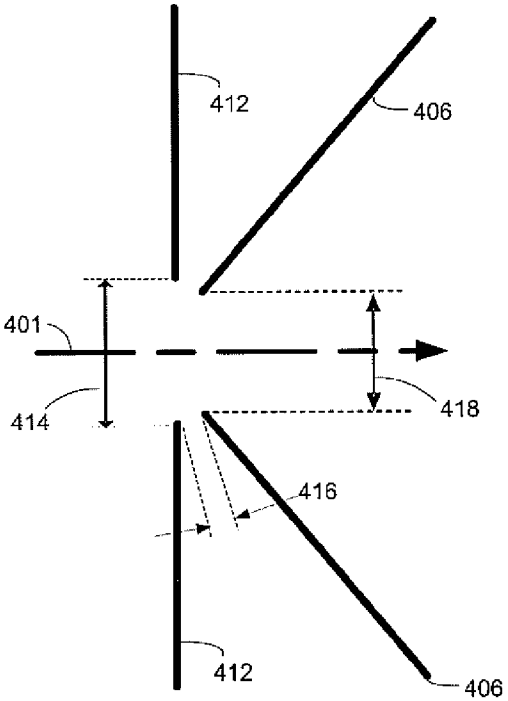
FIG. 4C is further exemplary schematic drawing of alternate ion sampling interface configurations in accordance with the applicants' teachings.
Figure 4B:
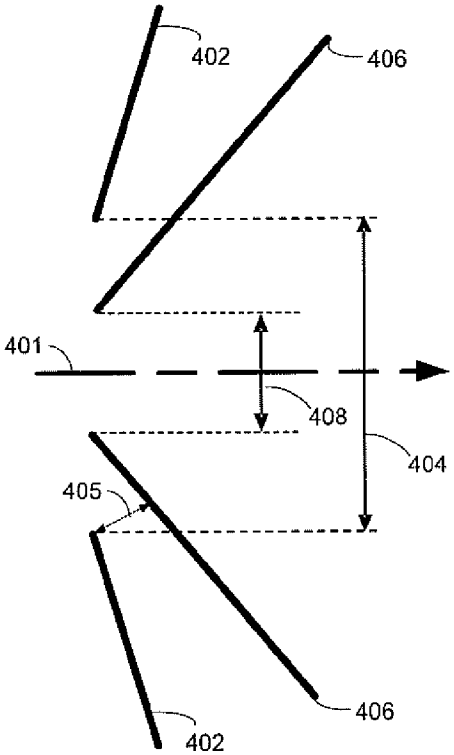
FIG. 4B is an expanded sectional view of FIG. 4A.
Figure 4A:
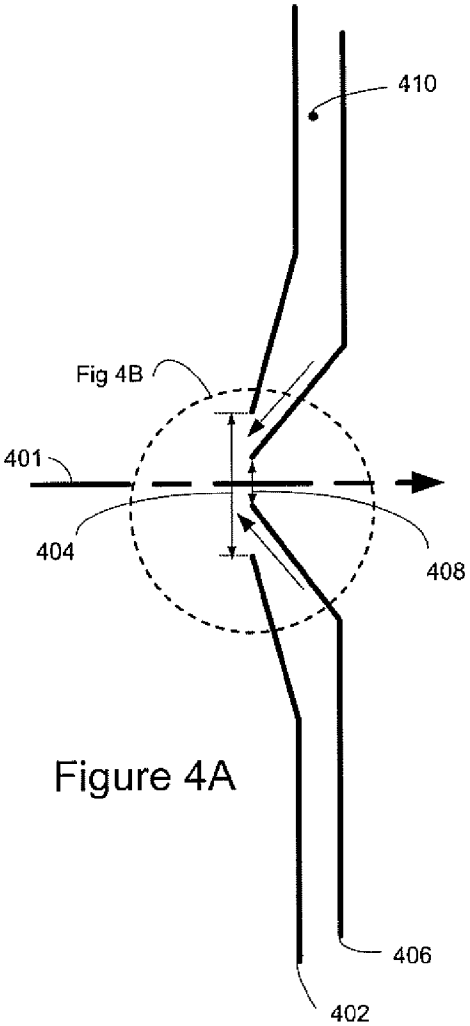
FIG. 4A is an exemplary schematic drawing of an alternate ion sampling interface configuration in accordance with the applicants' teachings.

FIGS. 4A to 4C show alternate configurations of modified sampling interfaces. FIG. 4A shows a curtain plate 402 having a conical aperture 404. Sampling member 406 has an orifice 408 and is substantially coaxially aligned with the curtain plate 402 and the aperture 404 along a common axis 401. The sampling member 406 is located in a proximity to the curtain plate 402 to produce a flow channel 410 between the curtain plate and sampling member 406. The proximity of the sampling member 406 to the curtain plate 402 also produces an annular gap between the aperture 404 and the orifice 408, as shown in an expanded sectional view in FIG. 4B, and indicated by the number 405. The area of the annular gap 405 that is formed around the circumference of the aperture 404 is approximately equal to the circumference of the aperture 404 multiplied by the width of the gap x. In the example of a circular aperture of diameter D, the circumference is equal to 70, and the area of the annular gap 405 is approximately equal to $\pi Dx$. This planar area of the annular gap around the aperture can be referred to as the circumferential gap area. The distance x is the closest linear distance between the sampling member 406 and the curtain plate 402, in the vicinity of the orifice 408. The area of the orifice 408 is smaller than the area of the aperture 404 in the curtain plate. The sampling member 406 can be positioned such that the orifice 408 is substantially in the same plane as the aperture 404.

When a curtain gas is introduced into the flow channel 410, the curtain gas is forced through narrower annular gap 405 between the orifice 408 and the aperture 404, establishing a non-uniform high velocity jet of gas across the orifice 408. The narrower the annular gap 405, the higher the velocity of the jet of gas across the orifice 408. This jet of gas across the orifice 408 repels droplets and clusters. Since a high velocity jet is produced as a result of the geometries and proximities of the curtain plate 402 and the sampling member 406, a lower curtain gas flow can be used than would be used in a standard sampling interface configuration.

The width across the annular gap 405 (or x) can vary from 0.1 mm to 1 mm, and is typically 0.5 mm. The diameter of the aperture 404 (or D) can vary from 2 mm to 10 mm, and is typically 4 mm. The diameter of the orifice 408 can vary from 0.3 mm to 2 mm, and is typically 0.75 mm.

It will be understood by those skilled in the art that orifice 408 and aperture 404 can be non-circular in shape. For example, orifice 408 and aperture 404 can be rectangular in shape. The narrow annular gap 405 between the curtain plate 402 and the sampling member 406 can be maintained around the circumference of the aperture 404 for any chosen shape.

Placement of the curtain gas in the configuration of FIG. 4A will allow the use of a smaller voltage difference between the curtain plate 402 and the sampling member 406 in order to focus the ions toward the orifice. For example, voltage differences of only 100 to 300V may be required, instead of voltages of 500 to 1000V that are commonly used in existing curtain plate geometries. This is because of the closely spaced geometry that produces a stronger electric field $E=V/x$ where V is the voltage difference between the curtain plate 402 and the sampling member 406. Since x is smaller than prior art geometries, the electric field is larger for the same value of V, or the same electric field strength can be created with a smaller value of V. Additionally, the geometry reduces diffusion losses between the curtain plate 402 and sampling member 406 that can result if the gap x is very large (for example, if there exists a very large distance between the curtain plate 402 and sampling member 406, then the ions are less efficiently transmitted through this large gap). Therefore the small annular gap 405 used to produce the jet of curtain gas, together with the proximity of the sampling orifice 408 to the ion source, with minimal shielding by the curtain plate 402, can provide better ion transmission and better sensitivity.

FIG. 4C shows an alternate configuration of a sampling interface. The curtain plate 412 is planar and has a planar aperture 414 rather than the protruding conical aperture 404 in FIGS. 4A and 4B. In this configuration, the aperture 414 is positioned before the sampling member 406 a distance of an annular gap 416 defined by the gap between the aperture 414 and the orifice 418.

Figure 5A:
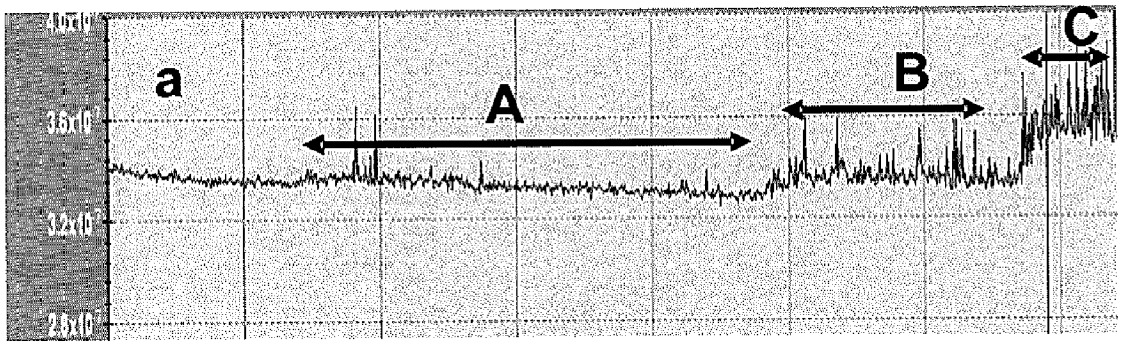
FIG. 5A is exemplary data from a residual gas analyzer showing a plot of the water vapor concentration in the vacuum chamber, using the prior art sampling interface configuration of FIG. 2.

FIG. 5A is a plot of water vapor concentration in the vacuum chamber of the mass spectrometer having the prior art sampling interface configuration of FIG. 2, as measured by a residual gas analyzer (RGA). The water vapor in the vacuum chamber is partly a result of penetration of water droplets and clusters from the ion source, through the curtain gas. Part of the water vapor signal is due to water vapor that is desorbed continuously from the walls of the vacuum chamber, as is known in the art. FIG. 5A shows the plot of water vapor concentration measured during a period of approximately 10 minutes.

For the time prior to the beginning of period A, the LC pump is turned off, and no water droplets are created in the ion source. The water vapor signal prior to period A is due to water vapor desorbed from the walls of the vacuum chamber. At the beginning of period A, the LC pump is turned on, flowing 0.5 mL/min through the electrospray ion source. At the beginning of period B, the flow rate is increased to 1 mL/min, and at the beginning of period C, the flow rate is increased to 2 mL/min.

As shown in FIG. 5A, the water vapor signal becomes higher and noisier with larger spikes or bursts as the flow rate from the LC is increased. This result is due to penetration of droplets or clusters through the gas curtain region. These droplets or clusters partly evaporate in the vacuum chamber and increase the water vapor concentration recorded by the RGA. The spiky nature of the signal is a result of the heterogeneous and random nature of the droplet penetration, and the bursts of water vapor as droplets of different size evaporate in the chamber.

Figure 5B:
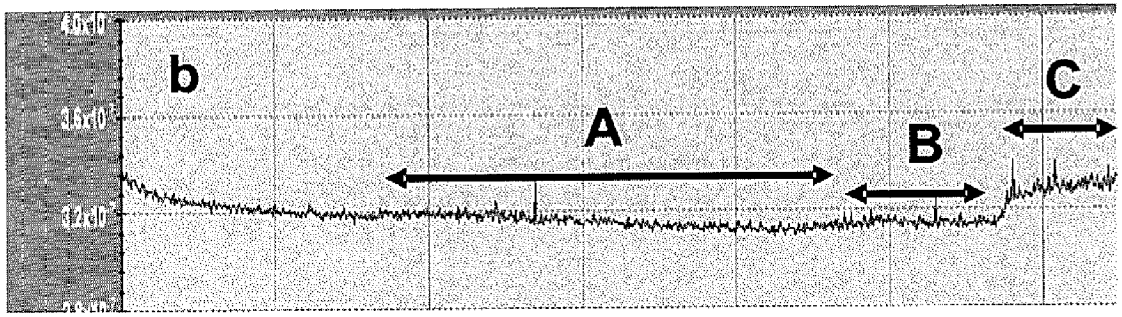
FIG. 5B is exemplary data from a residual gas analyzer showing a plot of the water vapor concentration in the vacuum chamber, using the sampling interface configuration of FIG. 4C.

FIG. 5B shows a plot of the water vapor concentration recorded in the vacuum chamber with an RGA, using the sampling interface configuration shown in FIG. 4B, and using the same flow rates as in FIG. 5A. In this experiment, the annular gap 405 between the aperture 404 and the sampling plate 406 was approximately 0.4 mm, and the diameter of the aperture 404 was approximately 3 mm. Therefore, the area of the aperture was 7.06 $mm^2$ and, accordingly, the area of the annular gap was 3.76 $mm^2$. The same experimental conditions with LC flows of 0, 0.5, 1, and 2 mL/min were used before period A, during period A, during period B, and during period C respectively. The increase in water vapor signal in FIG. 5B is less at each period than the corresponding periods in FIG. 5A. The signal is also less noisier and less spikier than in FIG. 5A, indicating that the high velocity jet of curtain gas across the orifice is effective at preventing penetration of droplets and clusters into the vacuum chamber.

Figure 6A:
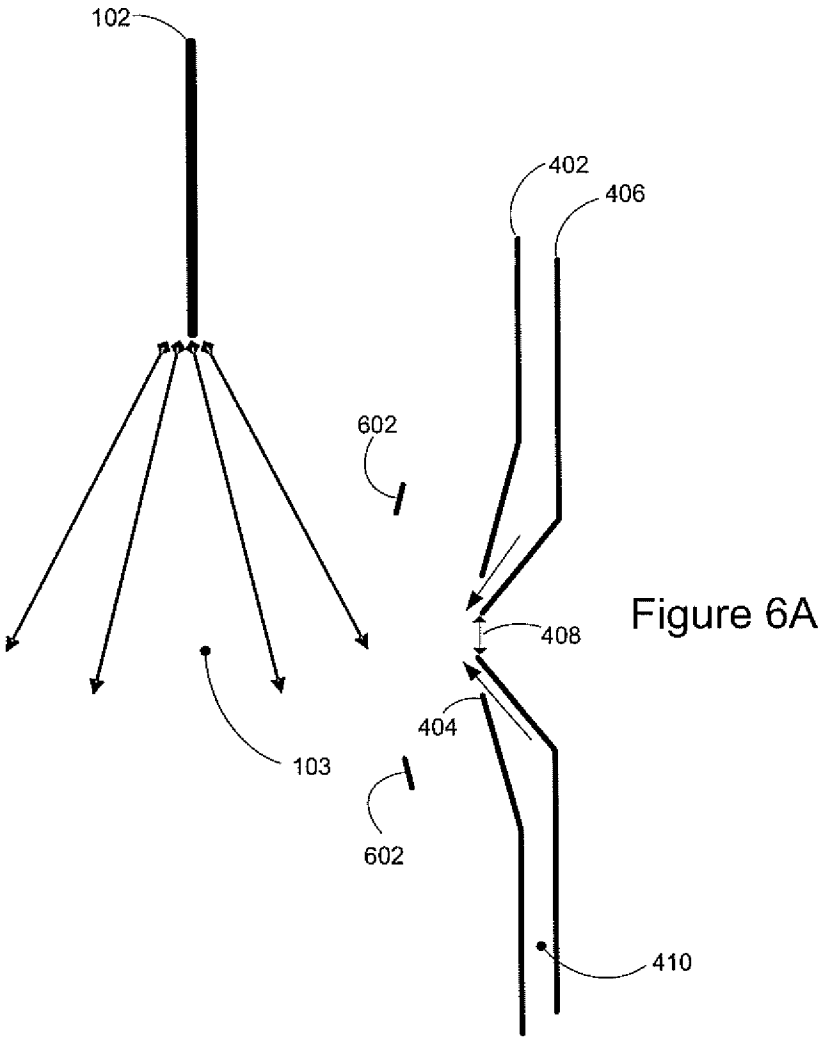
FIGS. 6A and 6B are schematic drawings of alternate ion sampling configurations in accordance with the applicants' teachings.

FIG. 6A is further alternate configuration of a sampling interface. A focusing ring 602 is positioned between the ion source 102 and the curtain plate and orifice configuration shown in FIG. 4A A voltage is applied by a power source (not shown) to focusing ring 602 to focus ions towards the aperture 404 and orifice 408. The focusing ring can help to further focus ions toward the sampling aperture 404 and increase the sensitivity.

Figure 6B:
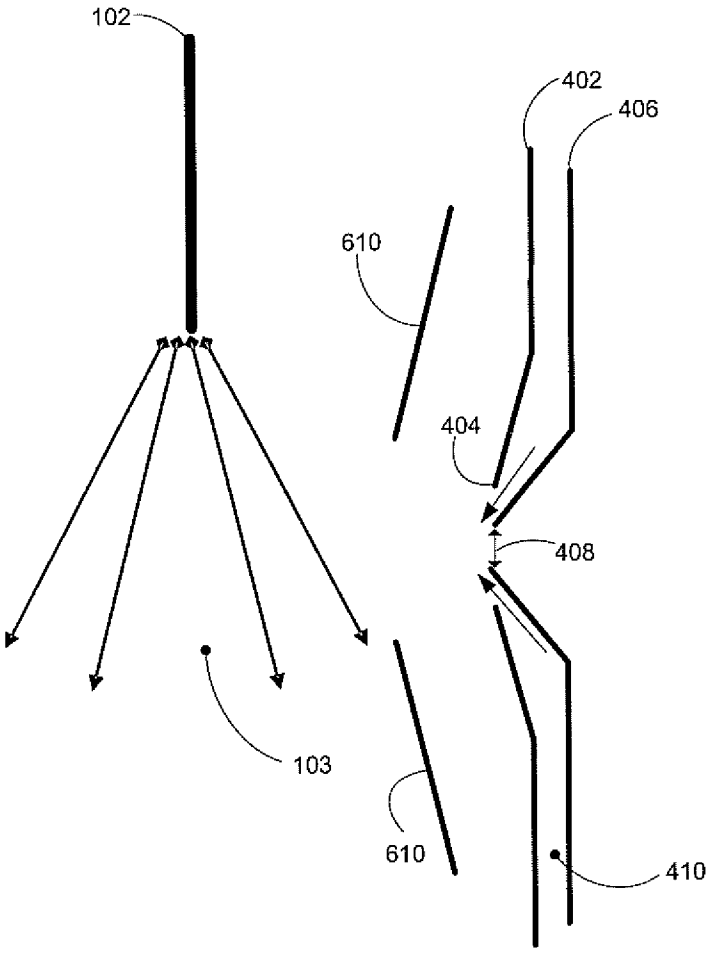

FIG. 6B is an alternate configuration of the sampling interface of FIG. 6A. Instead of a focusing ring 602 as in FIG. 6A, a focusing plate 610 is positioned between the ion source 102 and the curtain plate and orifice configuration shown in FIG. 4A. A voltage is applied by a power source (not shown) to focusing ring 610 to focus ions towards the aperture 404 and orifice 408.

Figure 7:
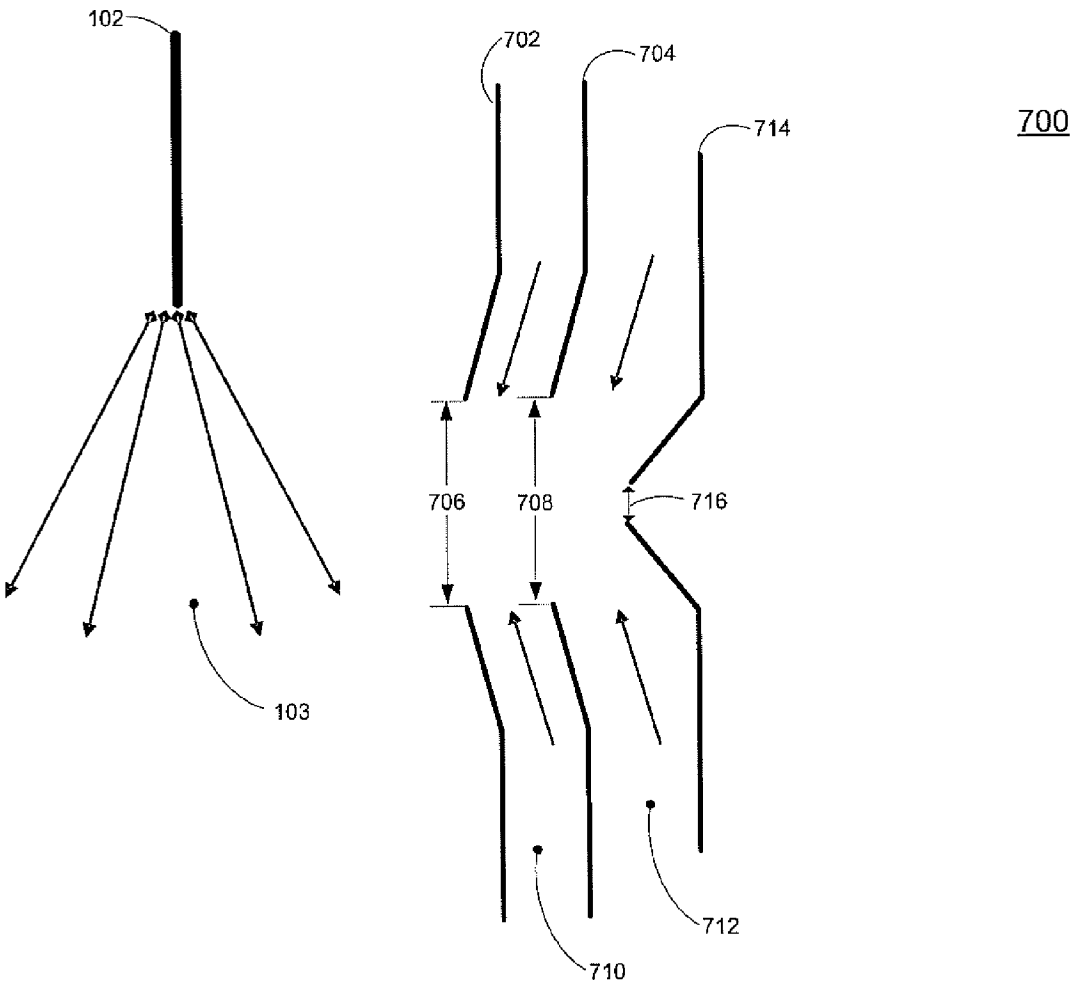
FIG. 7 schematically illustrates an exemplary ion sampling interface with a double curtain plate configuration in accordance with the applicants' teachings.

FIG. 7 is a two-stage configuration of a sampling interface, generally indicated by the number 700, in which two curtain plates 702, 704 are positioned between the ion source 102 and the sampling member 714. Curtain plates 702 and 704 have apertures 706 and 708 therein coaxially aligned with an orifice 716 in sampling member 714. Curtain plates 702 and 704 are positioned to define a first and second curtain chamber 710 and 712 respectively. The first curtain chamber 710 is defined by the space between the first and second curtain plates 702 and 704 respectively. The second curtain chamber 712 is defined by the space between the second curtain plate 704 and the sampling member 714.

A first curtain gas flow is directed into the first curtain gas chamber 710 and a second curtain gas flow is directed into the second curtain gas chamber 712. The first and second curtain gas flows can be adjusted independently or together. Each curtain plate 702 and 704 is isolated electrically from the other, permitting independent voltages to be applied to each plate with separate power supplies (not shown). Ions from the ion source 102 are focused through the first curtain gas chamber 710 and then through the second curtain gas chamber 712 before they are carried into the vacuum chamber (not shown) by the gas suction through the orifice 716. In a further alternate configuration, the sampling interface is not limited to two curtain plates defining two curtain chambers but can have a plurality of curtain plates defining a plurality of curtain chambers. The voltages applied to each plate can be adjusted to provide optimum focusing of the ions. The use of two or more curtain gas chambers can provide better protection of the sampling orifice, with greater efficiency of preventing droplets and clusters from entering the vacuum chamber. This better protection is a result of the greater thickness or depth of the region of curtain gas, thus providing more time for the droplets to evaporate, and providing greater resistance to the droplets being carried toward the sampling orifice and into the vacuum chamber.

The use of two separate curtain gas chambers can allow the use of different flows and different flow velocities in the two chambers. For example, the outward flow velocity in the first curtain chamber 710 may be high in order to exclude larger droplets. The flow in the second curtain gas chamber 712 can be lower in order to make it easier to focus the ions through, because the large droplets have been excluded from this region by the flow in the first curtain gas chamber 710. Additionally, different gas compositions can be used in the two chambers. For example, nitrogen gas can be used in the first chamber 710 because it has larger heat capacity than helium, and can more effectively dry the droplets. Helium can be used in the second chamber 712, allowing ions to be easily focused through the lighter helium gas due the higher mobility of ions in helium gas than in nitrogen, and allowing only helium gas to enter the vacuum chamber. This can be advantageous to minimize fragmentation of the ions in the first vacuum chamber, because collisions between ions and lighter helium gas can result in less unwanted fragmentation than collisions with nitrogen gas, which is heavier.

Additionally, other gases can be added to the first or second chamber in order to react with the ions. Some reagent gases can be used to reduce chemical noise, or to reduce the charge state of multiply-charged ions, or to react with the ions to produce specific adducts or product ion species that make the analysis more specific. In many cases, it is desirable to prevent reactive gas species from entering into the vacuum chamber. The second curtain gas chamber 712 can therefore be supplied with a pure gas such as nitrogen in order to prevent reactive gases from the first curtain gas region from entering the vacuum chamber. This keeps the vacuum chamber clean, and minimizes clustering of ions in the free jet expansion that can occur if polar reactive species are present in the gas expanding into vacuum. Therefore multiple curtain gas chambers can be used to separate reaction regions from the vacuum chamber, and thereby keep reactive species out of the vacuum chamber. In some cases, ionic species can be added to the first curtain gas chamber 710 in order to react with the ions from the ion source (for example specific negative ions can react with positive ions to form specific product ions). In some cases, two or more different reagent gases can be added to the two or more separate curtain gas chambers to cause sequential reactions as the ions pass through the two chambers.

Figure 8:
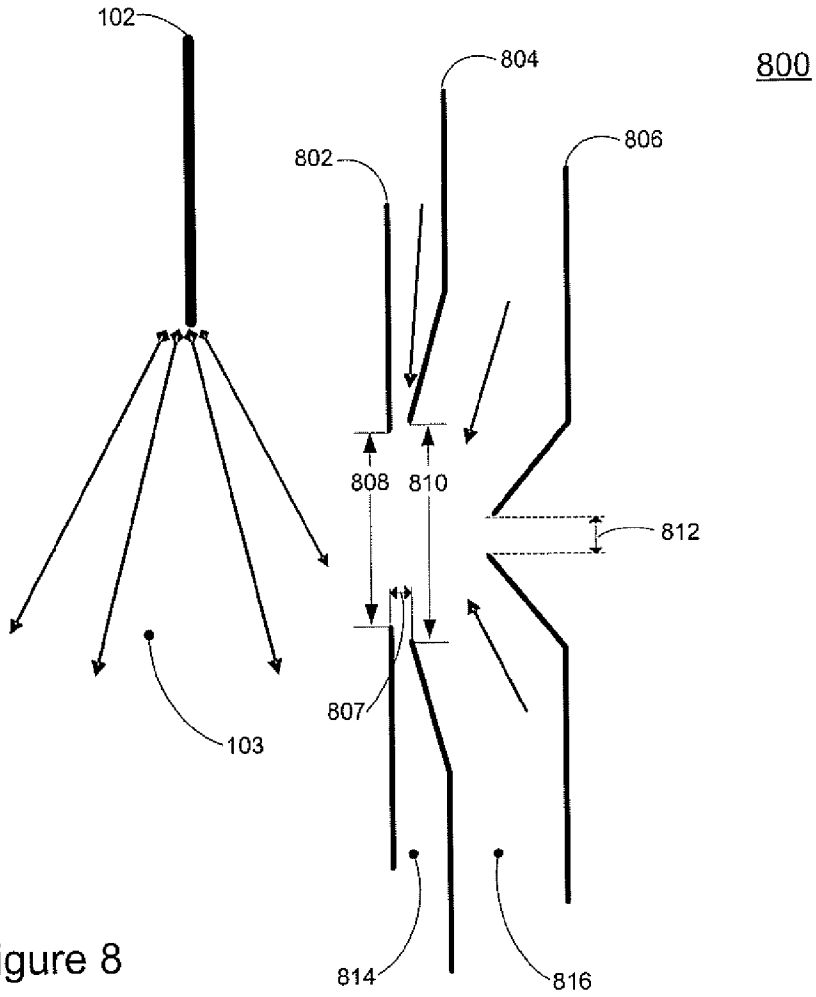
FIG. 8 schematically illustrates an alternate arrangement of the exemplary configuration in FIG. 7.

FIG. 8 is an alternative two-stage configuration of the sampling interface, generally indicated by the number 800, in which the double curtain chamber is combined with the apparatus of FIG. 4A. In this configuration, a first curtain plate 802 is positioned between the ion source 102 and a second curtain plate 804. The first curtain plate 802 is planar and has a planar first aperture 808. The second curtain plate 804 has a protruding conical aperture 810. The second curtain plate is positioned in close proximity to the first curtain plate 802 to form a curtain flow channel 814 and an annular gap 807 between the first and second aperture. The second curtain plate is positioned between the first curtain plate 802 and a sampling member 806. Sampling member 806 has a protruding conical orifice 812. The first aperture 808, second aperture 810, and orifice 812 are coaxially aligned along a common axis. The second curtain plate 804 and the sampling member 806 are positioned to form a curtain chamber 816.

When a first curtain gas is released in the flow channel 814, the curtain gas is forced through narrower annular gap 807 between the first aperture 808 and the second aperture 810, establishing a non-uniform high velocity jet of gas across the second aperture 810. The narrower the annular gap 807, the higher the velocity of the jet of gas across the second aperture 810. This jet of gas across the second aperture 810 repels droplets and clusters. Since a high velocity jet is produced as a result of the geometries and proximities of the first curtain plate 802 and the second curtain plate 804, a lower first curtain gas flow can be used than would be used in a standard sampling interface configuration. As the ions enter the curtain chamber 816 between the second curtain plate 804 and the sampling member 806, a second curtain gas is directed in the curtain chamber 816 before they a carried into the vacuum chamber (not shown) by the gas suction through the orifice 812.

Figure 9A:
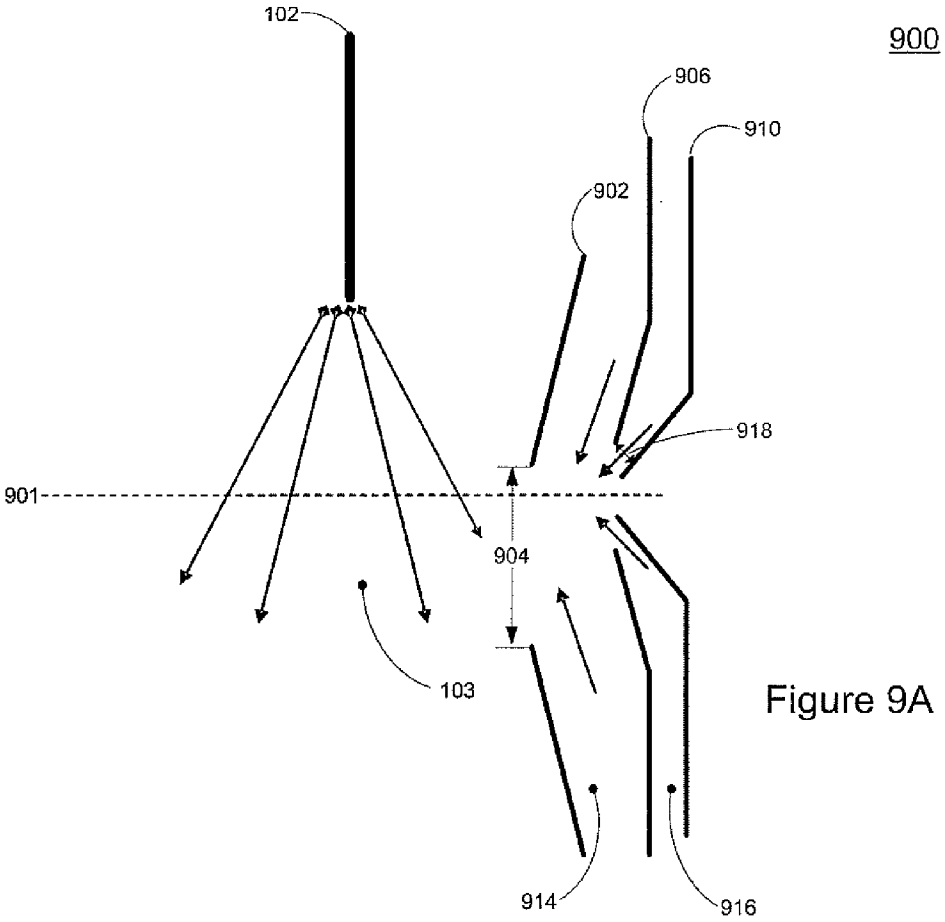
FIGS. 9A and B are schematic drawings illustrating different views of an alternate arrangement of the exemplary configuration in FIG. 7.
Figure 9B:
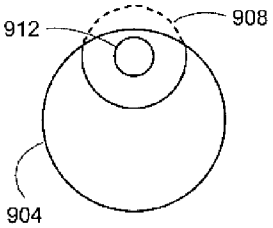

FIG. 9A is an alternative two-stage off-axis configuration of the sampling interface of FIG. 8 and is generally numbered 900. In this configuration, the center of the aperture 904 in the first curtain plate 902 is located off-axis from the common axis 901. The common axis 901 is defined as the axis on which the center of the aperture 908, seen in FIG. 9B, of the second curtain plate 906 and the center of the orifice 912, seen in FIG. 9B, of the sampling member 910 line up. The centre of the first curtain plate aperture 904 is positioned lower than the second aperture 908 relative to an axis substantially orthogonal to the axis 901. Ions 103 can be focused through the apertures into the vacuum chamber by voltages applied by a power source (not shown) independently to the first curtain plate 902, second curtain plate 906 and the sampling member 910.

Ions 103 move through the first curtain gas in the first curtain chamber 914, which is formed by the space between the first curtain plate 902 and the second curtain plate 906. The ions 103 move towards the second aperture 908. The second curtain plate 906 and the sampling member 910 are spaced to form a curtain flow channel 916 through which the second curtain gas is directed. In this example, the center of the first aperture 904 is lower than the common axis 901. Momentum from the first curtain gas carries the heavier droplets and clusters down away from the second aperture 906 and orifice 912, whereas the lighter ions will turn and flow into the orifice 912.

When a second curtain gas is released in the flow channel 916, the second curtain gas is forced through narrower annular gap 918 between the second aperture 908 and the orifice 912, establishing a non-uniform high velocity jet of gas (indicated by the arrows) across the orifice 912. The narrower the annular gap 918, the higher the velocity of the jet of gas across the orifice 912. This jet of gas across the orifice 912 repels droplets and clusters. Since a high velocity jet is produced as a result of the geometries and proximities of the second curtain plate 906 and the sampling member 910, a lower second curtain gas flow can be used than would be used in a standard sampling interface configuration. The ions 103 are then carried into the vacuum chamber (not shown) by the gas suction through the orifice 918.

While the applicants' teachings have been particularly shown and described with reference to specific illustrative embodiments, it should be understood that various changes in form and detail may be made without departing from the spirit and scope of the teachings. Therefore, all embodiments that come within the scope and spirit of the teachings, and equivalents thereto, are claimed. The descriptions and diagrams of the methods of the applicants' teachings should not be read as limited to the described order of elements unless stated to that effect.

While the applicants' teachings have been described in conjunction with various embodiments and examples, it is not intended that the applicants' teachings be limited to such embodiments or examples. On the contrary, the applicants' teachings encompass various alternatives, modifications, and equivalents, as will be appreciated by those of skill in the art, and all such modifications or variations are believed to be within the sphere and scope of the invention.

What is claimed is:

1. A mass spectrometer system comprising:

an ion source for generating ions at substantially atmospheric pressure;

a sampling member having an orifice therein, the sampling member forming a vacuum chamber with a mass spectrometer;

a curtain plate between the ion source and the sampling member, the curtain plate having an aperture therein, the curtain plate aperture being coaxially aligned with the sampling member orifice, the aperture having a cross-section and being spaced from the sampling member to define a flow passage between the curtain plate and the sampling member, and to define an annular gap between the orifice and the aperture, the area of the annular gap being less than the cross-sectional area of the aperture;

a power supply for applying a voltage to the curtain plate to direct ions from the ion source to the aperture in the curtain plate; and a curtain gas flow mechanism for directing a curtain gas into the flow passage and the annular gap, wherein the curtain gas forms a high velocity jet in front of the orifice.

2. The mass spectrometer of claim 1, wherein the area of the annular gap is less than 50% of the area of the aperture.

3. The mass spectrometer of claim 1, wherein the annular gap is less than 0.5 mm.

4. The mass spectrometer of claim 1, wherein the annular gap is less than 0.3 mm.

5. A mass spectrometer system comprising:

an ion source for generating ions at substantially atmospheric pressure;

at least two curtain plates, each curtain plate of the at least two curtain plates having an aperture, each curtain plate spaced to form a plurality of flow passages therebetween;

a sampling member having an orifice therein, at least one of the curtain plate apertures being coaxially aligned with the sampling member orifice, the sampling member forming a vacuum chamber with a mass spectrometer, the sampling member being spaced away from the at least two curtain plates forming a flow passage therebetween;

a power supply voltage for applying independent voltages to each curtain plate to direct ions through each of the apertures of each curtain plate;

at least one gas flow mechanism for directing curtain gases into each of the plurality of flow passages.

6. The mass spectrometer of claim 5 wherein the curtain gases have different composition.

7. An ion sampling interface for receiving ions from an ion source, the ion sampling interface comprising:

a first curtain plate having a first aperture therein for receiving the ions from the ion source;

a second curtain plate having a second aperture therein, the second curtain plate spaced from the first curtain plate to form a curtain chamber therebetween;

a sampling member having an orifice therein, at least one of the curtain plate apertures being coaxially aligned with the sampling member orifice, the sampling member forming a vacuum chamber with a mass spectrometer; the sampling member, spaced from the second curtain plate to form a curtain flow channel therebetween, the sampling member defining an annular gap between the orifice and the second aperture, the area of the annular gap being less than the cross-sectional area of the aperture;

a first power supply for applying a voltage to the curtain plate to direct ions from the ion source to the first aperture in the first curtain plate;

a second power supply for applying a voltage to the second curtain plate to direct ions to the orifice; and a curtain gas flow mechanism for directing a curtain gas into the flow passage and the annular gap, the curtain gas generating a high velocity jet of gas across the orifice as the curtain gas flow passes through the annular gap.

* * * * *